US010189611B2

(12) United States Patent
Cox

(10) Patent No.: US 10,189,611 B2
(45) Date of Patent: Jan. 29, 2019

(54) CLOSURE COMBINATION

(71) Applicant: Obrist Closures Switzerland GmbH, Reinach (CH)

(72) Inventor: Thomas Cox, Norwich (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/118,478

(22) PCT Filed: Feb. 10, 2015

(86) PCT No.: PCT/EP2015/052779

§ 371 (c)(1),
(2) Date: Aug. 11, 2016

(87) PCT Pub. No.: WO2015/121262

PCT Pub. Date: Aug. 20, 2015

(65) Prior Publication Data

US 2017/0174398 A1 Jun. 22, 2017

(30) Foreign Application Priority Data

Feb. 14, 2014 (GB) ..... 1402604.1

(51) Int. Cl.
*B65D 41/04* (2006.01)
*B65D 55/02* (2006.01)
(Continued)

(52) U.S. Cl.
CPC ..... *B65D 41/0471* (2013.01); *B65D 1/0246* (2013.01); *B65D 47/0804* (2013.01);
(Continued)

(58) Field of Classification Search
CPC ..... B65D 41/0471; B65D 55/02; B65D 47/0804; B65D 1/0246; B65D 2255/20; B65D 2251/04; B65D 47/08; B65D 41/04
(Continued)

(56) References Cited

U.S. PATENT DOCUMENTS 3,435,978 A * 4/1969 Wittwer ..... B65D 41/0471 215/217
4,877,144 A 10/1989 Thanisch
(Continued)

FOREIGN PATENT DOCUMENTS

DE 3814786 11/1989
EP 1302406 4/2003
(Continued)

*Primary Examiner* — James N Smalley
(74) *Attorney, Agent, or Firm* — Lightbulb IP, LLC

(57) ABSTRACT

A closure combination (101) comprising a dispensing closure body (102) and a container neck (103). The dispensing closure body (102) and container neck (103) comprise co-operable screw threads (104, 105) that allow the dispensing closure body (102) to be screwed onto the container neck (103) into an engaged condition. The co-operable screw threads (104, 105) prevent the dispensing closure body (102) from being unscrewed from the container neck (103) after the dispensing closure body (102) has been screwed onto the container neck (103) into a locked condition. A dispensing closure body (102) comprising an internal screw thread (10) that comprises a reversed-thread run out portion (107). A container with a container neck (103) comprising an external screw thread (105) that comprises a reversed-thread run out portion (108). A method of providing a tamper-resistance container closure combination (101).

12 Claims, 6 Drawing Sheets

(51) Int. Cl.
*B65D 1/02* (2006.01)
*B65D 47/08* (2006.01)

(52) U.S. Cl.
CPC ..... *B65D 55/02* (2013.01); *B65D 41/04* (2013.01); *B65D 47/08* (2013.01); *B65D 2251/04* (2013.01); *B65D 2255/20* (2013.01)

(58) Field of Classification Search
USPC ..... 215/330, 331
See application file for complete search history.

(56) References Cited

U.S. PATENT DOCUMENTS

| | | | | |
|---|---|---|---|---|
| 5,020,682 | A * | 6/1991 | Dutt | B65D 41/0471 215/216 |
| 2008/0296251 | A1 | 12/2008 | Johnston | |

FOREIGN PATENT DOCUMENTS

| | | |
|---|---|---|
| GB | 2189475 | 10/1987 |
| GB | 2358626 | 8/2001 |
| WO | WO9107331 | 5/1991 |
| WO | WO0144067 | 6/2001 |
| WO | WO2014029594 | 2/2014 |

* cited by examiner (Prior Art)

(Prior Art)

CLOSURE COMBINATION

FIELD OF THE INVENTION

The present invention relates to a closure combination, in particular to a closure combination comprising a dispensing closure body and a container neck.

BACKGROUND OF THE INVENTION

A known type of dispensing closure for a container defines a dispensing aperture that is significantly smaller than the aperture of the container neck.

Different arrangements of a dispensing closure are known. In one arrangement, the dispensing closure has a body comprising an upper wall in which the dispensing aperture is defined. The dispensing closure may be provided with a top for selectively covering the dispensing aperture, to preserve contents and to prevent spillage, and selectively uncovering the dispensing aperture, to allow product to be dispensed therethrough. The top may be removable, or may be so hinged that it can be flipped open and closed. In another arrangement, the dispensing closure has a disc top in which a dispensing aperture is formed and which can be rotated about a pivot between opened and shut positions.

A dispensing closure may, for example, be used on a squeezable bottle with edible or non-edible fluid contents, such as sauce, honey, syrup, oil, gel, cream, cleanser, toner, moisturiser, shampoo or conditioner.

It is known for a dispensing closure to have a body comprising an internal thread that allows the dispensing closure body to be screwed onto, and off, a container neck having an external thread.

SUMMARY OF THE INVENTION

According to a first aspect there is provided a closure combination comprising a dispensing closure body and a container neck, said dispensing closure body and said container neck comprising co-operable screw threads that allow said dispensing closure body to be screwed onto said container neck into an engaged condition, wherein said co-operable screw threads prevent said dispensing closure body from being unscrewed from said container neck after said dispensing closure body has been screwed onto said container neck into a locked condition.

In an embodiment, the dispensing closure body is brought into the locked condition by being screwed onto the container neck beyond a locking position.

In an embodiment, the co-operable screw threads of the dispensing closure body and the container neck comprise co-operable reverse-thread portions. In an embodiment, the co-operable screw threads of the dispensing closure body and the container neck comprise co-operable reversed-thread run out portions. The co-operable screw threads of the dispensing closure body and the container neck may be arranged such that when the dispensing closure body has been screwed onto the container neck into the locked condition, the reversed-thread run out portion of one of the co-operable screw threads extends into a break region between the reversed-thread run out portion and a spaced apart lug element of the other of the co-operable screw threads.

In an embodiment, the dispensing closure body comprises an internal screw thread and the container neck comprises an external screw thread.

The co-operable screw threads of the dispensing closure body and the container neck may be single start or multi-start.

The dispensing closure body may define a single dispensing aperture or a plurality of dispensing apertures.

According to a second aspect there is provided a dispensing closure body usable in the closure combination of the first aspect.

According to a third aspect there is provided a container having a container neck usable in the closure combination of the first aspect.

According to a fourth aspect there is provided a dispensing closure body comprising an internal screw thread, the internal screw thread comprising a reverse-thread portion. The internal screw thread may comprise a reversed-thread run out portion. The dispensing closure body may form the base of a two-part dispensing closure. The two-part dispensing closure may be a flip-top closure.

According to a fifth aspect there is provided a container comprising a container neck, the container neck comprising an external screw thread, the external screw thread comprising a reverse-thread portion. The external screw thread may comprise a reversed-thread run out portion.

According to a sixth aspect there is provided a dispensing closure body and a container, said dispensing closure body comprising an internal screw thread and the neck finish of said container comprising an external screw thread, said internal thread of said dispensing closure body and said external thread of said container neck being so co-operable as to allow said dispensing closure body to be screwed onto said container neck into an engaged condition, wherein at least one of said internal thread of said dispensing closure body and said external thread of said container neck comprise a reverse-thread portion.

According to a seventh aspect there is provided a method of providing a tamper-resistance container closure combination, said method comprising the steps of: providing a dispensing closure body comprising a screw thread; and providing a container with a container neck, said container neck comprising a screw thread; said screw threads of said dispensing closure body and said container neck being co-operable to allow said dispensing closure body to be screwed onto said container neck into an engaged condition; wherein said screw threads comprise co-operable reverse-thread portions that together define a locking position, and rotational engagement of said screw threads beyond said locking position brings said dispensing closure into a locked condition in which said dispensing closure body is prevented from being unscrewed from said container neck.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE DRAWINGS

The present invention will now be more particularly described, with reference to the accompanying drawings, in which.

DESCRIPTION

Figure 9:
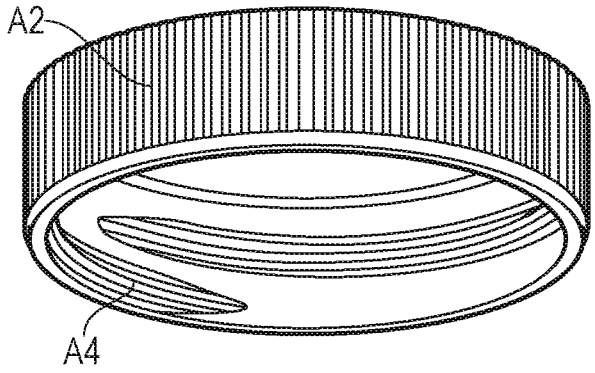
FIG. 9 (Prior Art)
FIG. 9 shows a prior art closure combination, comprising a prior art dispensing closure having a standard internal screw thread and a prior art container neck having a standard external screw thread.
Figure 9:
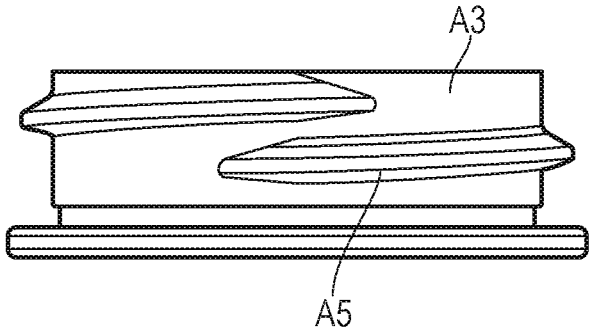
FIG. 9 (Prior Art)
Figure 9:
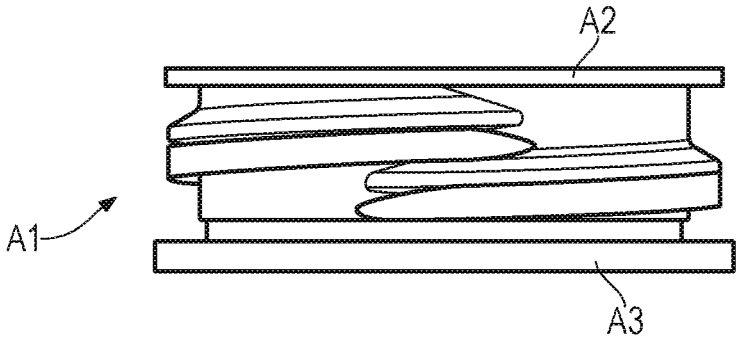
FIG. 9 (Prior Art)

A prior art closure combination Al is shown in FIG. 9. The closure combination Al comprises a dispensing closure A2 and a container neck A3, which have co-operable standard internal and external screw threads A4, A5 respectively. As the dispensing closure A2 is screwed onto the container neck A3, in a first rotational (clockwise) direction, the internal screw thread A4 of the closure A2 engages with the external screw thread A5 of the container neck A4. The standard internal and external screw threads A4, A5 of the dispensing closure A2 and container neck A3 respectively are releasably engageable such that, following full engagement, the dispensing closure A2 can be unscrewed from the container neck A3, in a second, opposite rotational (anti-clockwise/counter-clockwise) direction.

A problem exists in that the removable dispensing closure provides an opportunity for the contents of the container to be changed for, or re-filled with, an alternative product. Potential detrimental consequences of such an act include consumers being misled and reputational damage to a brand.

It is therefore desirable to provide a closure combination that prevents the dispensing closure from being unscrewed from the container neck.

Figure 1:
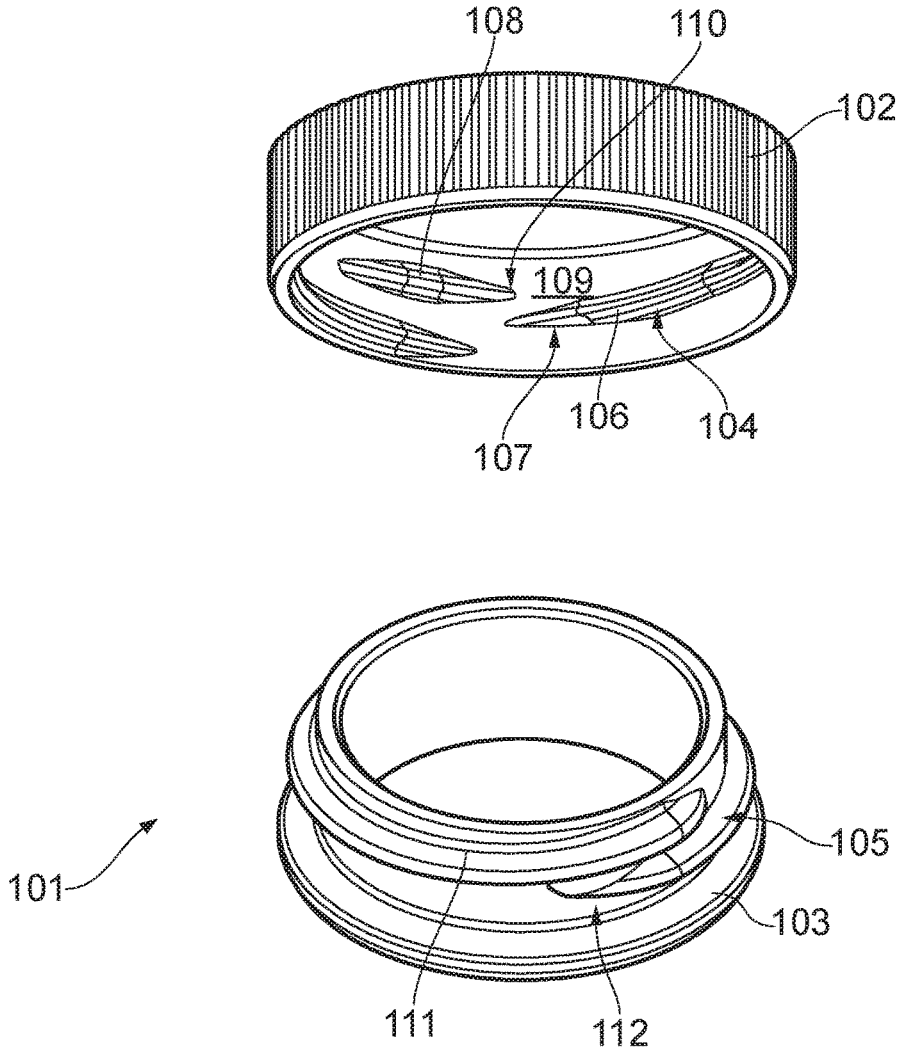
FIG. 1 shows a closure combination embodying the present invention, comprising a dispensing closure body and a container neck.

FIG. 1 shows a closure combination 101 embodying the present invention. The closure combination 101 comprises a dispensing closure body 102 and a container neck 103. The dispensing closure body 102 and container neck 103 comprise co-operable screw threads that allow the dispensing closure body 102 to be screwed onto the 103 container neck into an engaged condition.

As will be described in further detail, the co-operable screw threads 104, 105 of the dispensing closure body 102 and container neck 103 prevent the dispensing closure body 102 from being unscrewed from the container neck 103 after the dispensing closure body 102 has been screwed onto the container neck 103 into a locked condition.

In this illustrated embodiment, the dispensing closure body 102 comprises an internal screw thread 104, and the container neck 103 comprises an external screw thread 105.

The screw threads 104, 105 of the dispensing closure body 102 and the container neck 103 comprise co-operable reverse-thread portions. The co-operable reverse-thread portions together define a locking position, and rotational engagement of the co-operating screw threads 104, 105 beyond the locking position brings the dispensing closure body 102 into the locked condition on the container neck 103.

In the specific arrangement shown in this Figure, the internal screw thread 104 of the dispensing closure body 102 comprises a ridge element 106 having a reversed-thread run out portion 107, and a lug element 108. The lug element 108 is so spaced from the ridge element 106 as to define a break region 109 between the reversed-thread run out portion 107 and an inner end 110 of the lug element 108. The external screw thread 105 of the container neck comprises a ridge element 111 having a reversed-thread run out portion 112.

Figure 2:
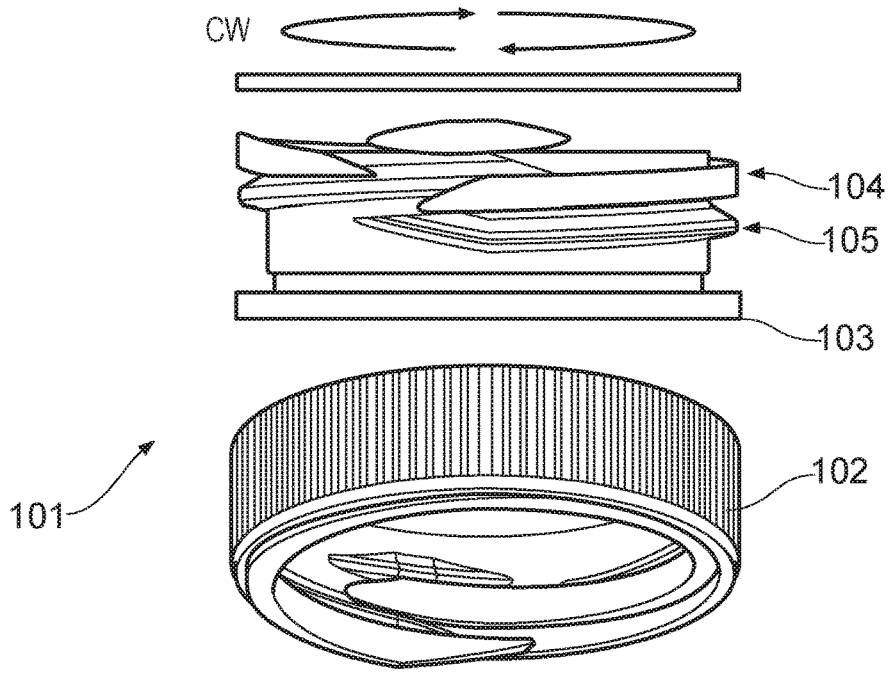
FIGS. 2, 3 & 4 show steps in screwing the dispensing closure body onto the container neck into a locked condition.
Figure 3:
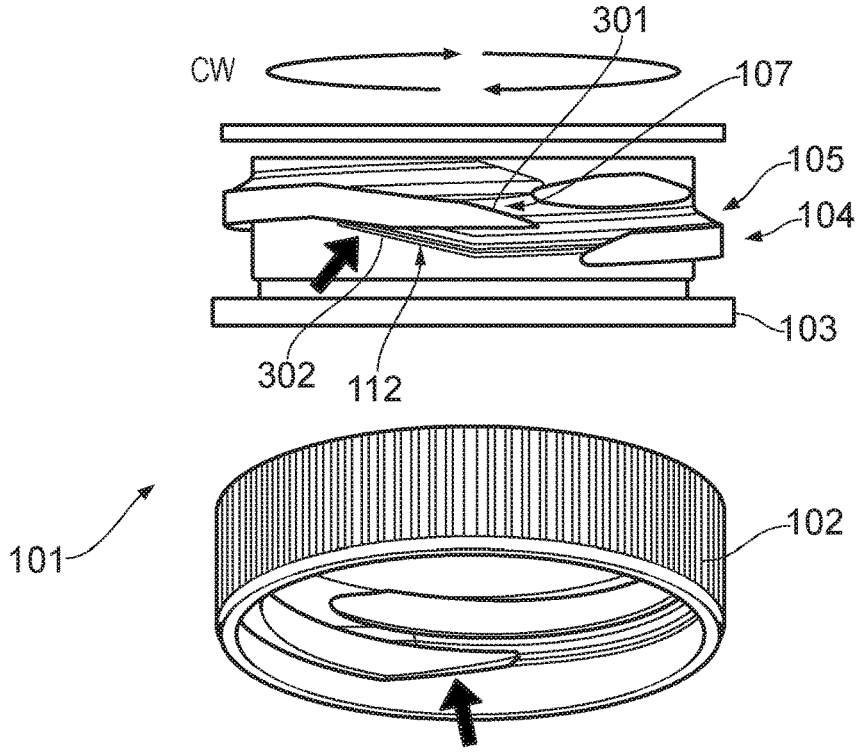
Figure 4:
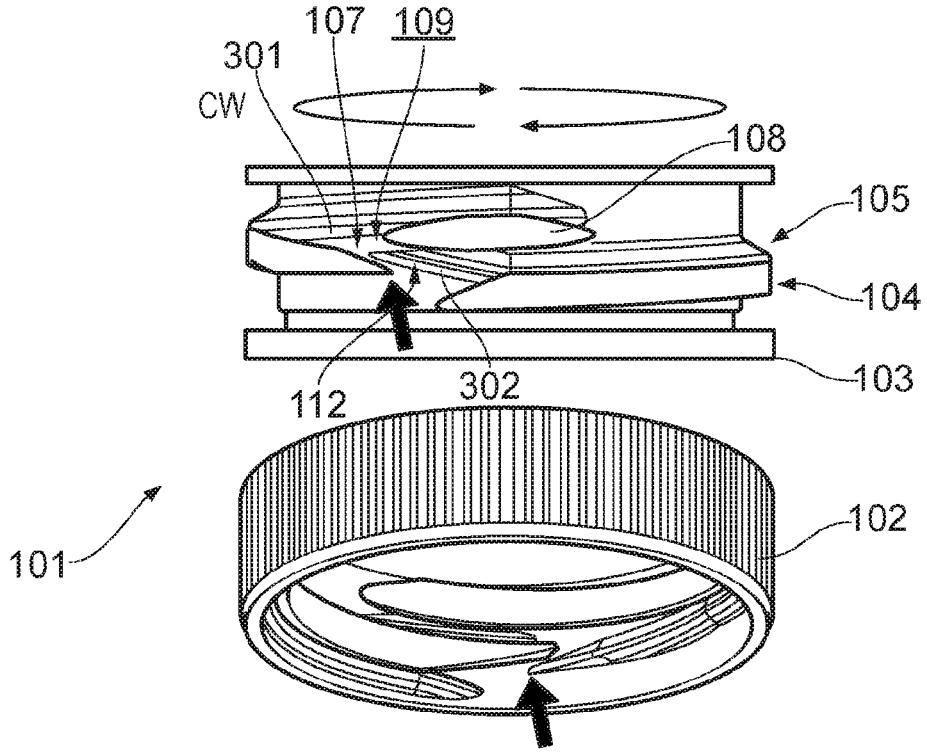

FIGS. 2, 3 & 4 show steps in securing the dispensing closure body 102 onto the container neck 103.

In FIG. 2, the dispensing closure body 102 is shown being screwed onto the container neck 103. As the dispensing closure body 102 is rotated, in a first rotational (clockwise) direction, the co-operating screw threads 104, 105 engage so that the dispensing closure body 102 begins to travel downwards along the container neck 103.

As illustrated in FIG. 3, as the dispensing closure body 102 is rotated further onto the container neck 103, the reversed-thread run out portions 107, 112 of the screw threads 104, 105 of the dispensing closure body 102 and container neck 103 begin to engage. According to the specific arrangement shown, the reversed-thread run out portion 107 of the dispensing closure body 102 has an inclined face 301, and the reversed-thread run out portion 112 of the container neck 103 has a complementary inclined face 302. According to this specific example, the co-operable reverse-thread portions 107, 112 together define a locking position at approximately 340° turn of the dispensing closure body 102 onto the container neck 103. Rotational engagement of the co-operating screw threads 104, 105 of the dispensing closure body 102 and the container neck 103 beyond the locking position locks the dispensing closure body 102 onto the container neck 103.

FIG. 4 shows the dispensing closure body 102 locked onto the container neck 103. The position of the dispensing closure body 102 on the container neck 103 after an approximately 360° turn of the dispensing closure body 102 onto the container neck 103 is shown. It can be seen that the inclined face 301 of the reversed-thread run out portion 107 of the dispensing closure body 102 and the inclined face 302 of the reversed-thread run out portion 112 of the container neck 103 are now facing each other. In addition, the reversed-thread run out portion 112 of the screw thread 105 of the container neck 103 extends into the break region 109 between the reversed-thread run out portion 107 and the lug element 108 of the screw thread 104 of the dispensing closure body 102.

Figure 5:
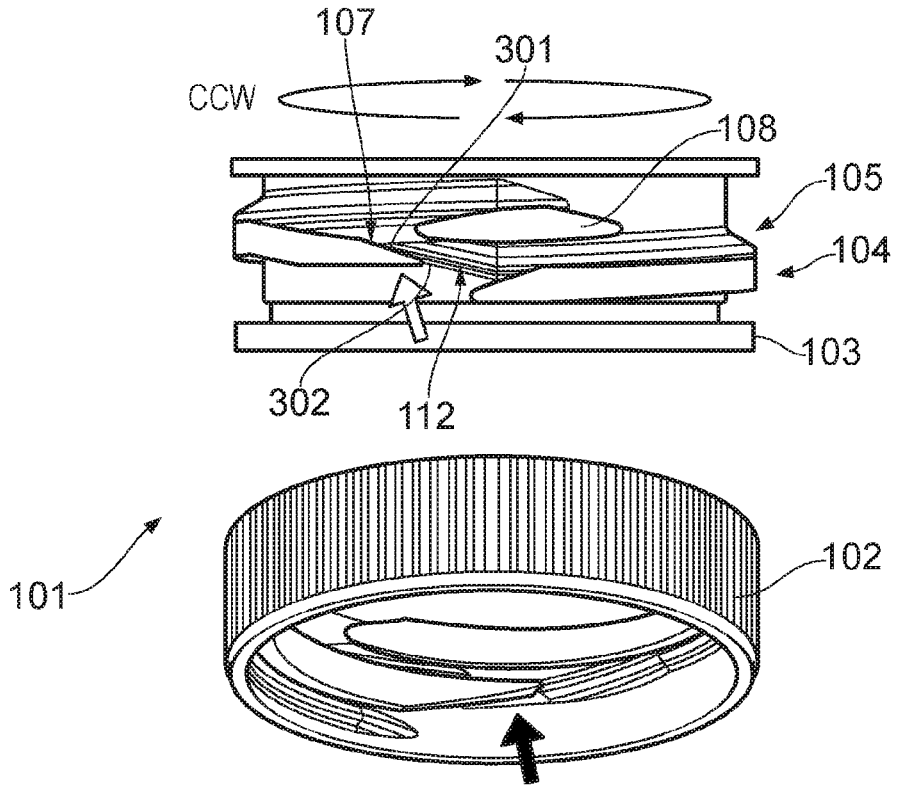
FIG. 5 shows how the dispensing closure body is prevented from being unscrewed from the container neck when in the locked condition.

FIG. 5 shows how the co-operable screw threads 104, 105 of the dispensing closure body 102 and the container neck 103 of the closure combination 101 prevent the dispensing closure body 102 from being unscrewed from the container neck 103. The position of the dispensing closure body 102 on the container neck 103 after being turned back to approximately 355° turn of the dispensing closure body 102 onto the container neck 103 is shown. As the dispensing closure body 102 is rotated, in the second, opposite rotational (anticlockwise) direction, the reverse-thread portions 107, 112 of the dispensing closure body 102 and the container neck 103 are brought into increasing contact, with the co-operating screw threads 104, 105 acting to force the dispensing closure body 102 back onto the container neck 103. According to the specific arrangement shown, as the dispensing closure body 102 is turned in the reverse rotational direction, to begin to travel upwards along the container neck 103, the reversed-thread run out portion 112 of the screw thread 105 of the container neck 103 is caused to extend further into the break region 109 between the reversed-thread run out portion 107 and the lug element 108 of the screw thread 104 of the dispensing closure body 102.

During rotational engagement of the dispensing closure body 102 onto the container neck, the dispensing closure body 102 can be unscrewed from the container neck 103 at any time before the locking position has been reached, but the dispensing closure body 102 cannot be unscrewed from the container neck 103 when the locking position has been reached.

It is to be appreciated that co-operable screw threads that allow a closure to be engaged upon a container neck can thus be arranged to also act to prevent the closure from being removed from the container neck, by interference between the screw threads. The co-operable screw threads may be single start or multi-start.

A simple and effective way of preventing a container with a dispensing closure from being re-filled is thus advantageously provided. In addition, a method of providing a tamper-resistance container closure combination is beneficially provided.

Another feature of the closure combination of FIGS. 1 to 5, embodying the present invention, will now be described. When the dispensing closure body 102 and the container neck 103 of FIGS. 1 to 5 are used together, the dispensing closure body 102 is lockable onto the container neck 103 to prevent subsequent removal of the dispensing closure body 102 from the container neck 103.

Figure 6:
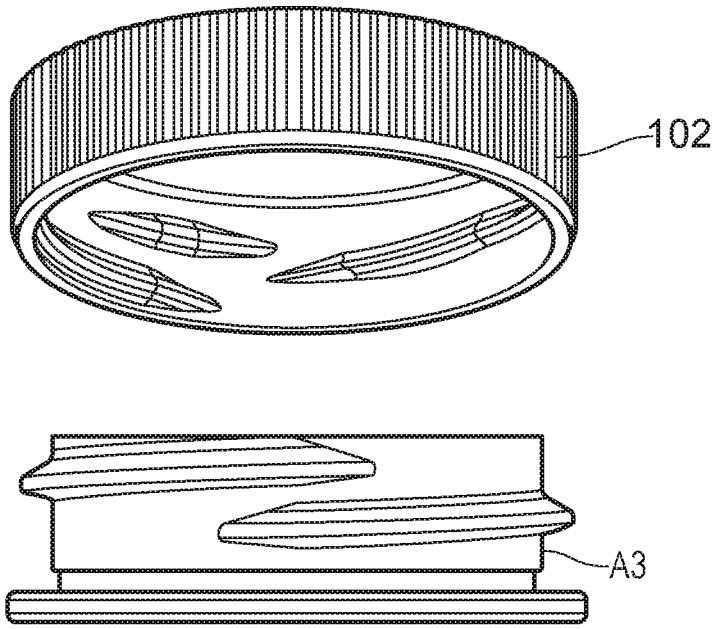
FIG. 6 shows the dispensing closure body of the closure combination of FIGS. 1 to 5 with the prior art container neck of FIG. 9.
Figure 7:
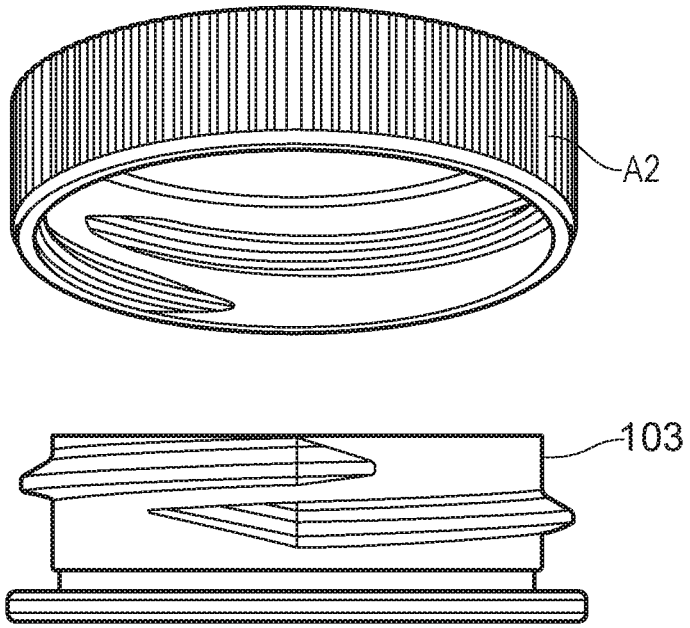
FIG. 7 shows the prior art dispensing closure body of FIG. 9 with the container neck of the closure combination of FIGS. 1 to 5.

As illustrated in FIG. 6, the dispensing closure body 102 of the closure combination of FIGS. 1 to 5 may be used with the prior art standard container neck A3 of the prior art closure combination of FIG. 9. Similarly, as illustrated in FIG. 7, the container neck 103 of the closure combination of FIGS. 1 to 5 may be used with the prior art standard dispensing closure A2 of the prior art closure combination of FIG. 9. In the closure combinations of FIGS. 6 and 7, the dispensing closure is not lockable onto the container neck by the respective screw threads; however, the dispensing closure body 102 and the container neck 103 being usable with a prior art standard container neck A3 and a prior art standard dispensing closure A2 respectively advantageously provides manufacturing flexibility.

A dispensing closure body usable in the closure combination of FIGS. 1 to 5 is provided. A container having a container neck usable in the closure combination of FIGS. 1 to 5 is provided is also provided. A dispensing closure body and a container comprising a container neck are provided, which may each be paired with the other to provide a closure combination as described with reference to FIGS. 1 to 5, or with the other part of a prior art standard closure combination to provide a closure combination as described with reference to FIGS. 6 and 7.

A dispensing closure body comprising an internal screw thread that comprises a reverse-thread portion is provided. A container comprising a container neck, the container neck comprising an external screw thread which comprises a reverse-thread portion is also provided. A dispensing closure body and a container are further provided, the dispensing closure body comprising an internal screw thread and the neck finish of the container comprising an external screw thread, the screw threads of the dispensing closure body and the container neck being so co-operable as to allow the dispensing closure body to be screwed onto the container neck into an engaged condition, and in which at least one of the screw threads of the dispensing closure body and the container neck comprises a reverse-thread portion. A dispensing closure body comprising an internal screw thread that comprises a reverse-thread portion and that is compatible with a container having a container neck comprising a prior art standard external screw thread formation is provided. A container having a container neck comprising an external screw thread which comprises a reverse-thread portion and that is compatible with a dispensing closure body that comprises a prior art standard external screw thread formation is further provided.

Figure 8:
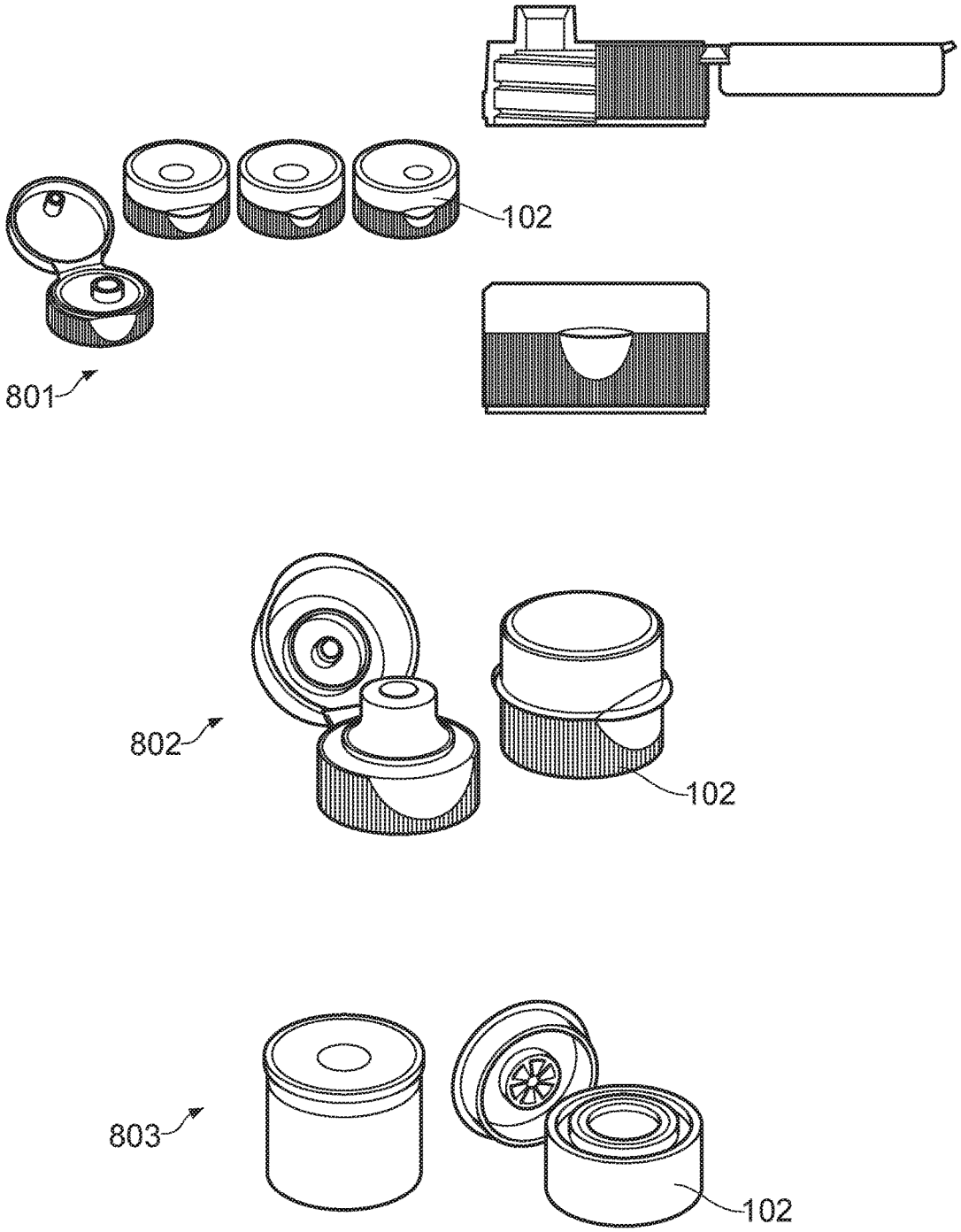
FIG. 8 shows examples of a flip-top closure comprising a dispensing closure body that forms the base of the flip-top closure.

A dispensing closure body comprising a screw thread that comprises a reverse-thread portion as described herein may form the base of a two-part closure. In an embodiment, the dispensing closure body forms the base of a flip-top closure. FIG. 8 shows different examples of a flip-top closure 801, 802, 803 having a base comprising the dispensing closure body 102 of the closure combination of FIGS. 1 to 5.

The dispensing closure body may have any suitable shape and dimensions. The dispensing closure body may define one or more dispensing apertures, in any suitable arrangement. The dispensing closure body may define dispensing apertures of different shapes and/or sizes. A dispensing aperture may be provided with a flow control and/or non-return flow device. A dispensing aperture may take the form of a spout. In an embodiment, the dispensing closure body comprises a top for selectively covering one or more dispensing apertures. The top may be one of: a flip-top lid, a push-fit cap, a twist-top lid, a rotatable lid. The dispensing closure body may be fabricated from any suitable material. The dispensing closure body may be fabricated from a plastics material. The dispensing closure body may be transparent, translucent or opaque.

The dispensing closure body may be used on any suitable type of container, which may have any suitable shape and dimensions. In an embodiment, the container is a squeezable container. The container may be fabricated from any suitable material. The container may be fabricated from a plastics material, or glass. The container may be transparent, translucent or opaque.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A closure combination comprising a closure body and a container neck, said closure body and said container neck comprising co-operable screw threads that allow said dispensing closure body to be screwed onto said container neck into an engaged condition, characterized in that the closure body screw thread and the container neck screw thread comprise co-operable reversed thread run-out portions, said co-operable reversed thread run-out portions defining a locking position, rotational engagement of the screw threads beyond the locking position locks the closure body onto the container neck, said co-operable reversed thread run-out portions are engageable to prevent said closure body from being unscrewed from said container neck after said dispensing closure body has been screwed onto said container neck into a locked condition by acting to force the closure body back onto the neck.

2. The closure combination as claimed in claim 1, wherein the closure body thread comprises a lug element, the lug element being spaced from the reverse thread run-out portion to define a break region.

3. The closure combination as claimed in claim 2, wherein when said dispensing closure body has been screwed onto said container neck into said locked condition, the reversed-thread run out portion of the neck screw thread extends into the closure body break region.

4. The closure combination as claimed in claim 1, in which the screw threads comprise ridge elements.

5. The closure combination as claimed in claim 1, wherein the locked position is at approximately 340° turn of the closure body onto the neck.

6. The closure combination as claimed in claim 1, wherein the screw threads are fully engaged at approximately 360° turn of the closure body onto the neck.

7. The closure combination as claimed in claim 1, wherein said dispensing closure body comprises an internal screw thread and said container neck comprises an external screw thread.

8. The closure combination as claimed in claim 1, wherein said co-operable screw threads are one of: single start, multi-start.

9. The closure combination as claimed in claim 1, wherein said closure body forms the base of a flip-top dispensing closure.

10. The closure combination as claimed in claim 9, wherein said closure body defines one of: a single dispensing aperture, a plurality of dispensing apertures.

11. A closure for engaging a container neck, said closure comprising a screw thread that allows it to be screwed onto said container neck into an engaged condition, characterized in that the screw thread comprises a reversed thread run-out portion for engaging a corresponding run-out portion on said container neck, said reversed thread run-out portion defining a locking position, rotational engagement of the screw thread beyond the locking position locks the closure onto the container neck in use, whereby said screw thread prevents said closure from being unscrewed from said container neck after said closure has been screwed onto said container neck into a locked condition by acting to force the closure back onto the container neck.

12. A container neck, said container neck comprising a screw thread that allows a closure to be screwed onto it into an engaged condition, characterized in that the screw thread comprises a reversed thread run-out portion for engaging a corresponding run-out portion on said closure, said reversed thread run-out portion defining a locking position, rotational engagement of the screw thread beyond the locking position locks the closure onto the container neck in use, whereby said screw thread prevents said closure from being unscrewed from said container neck after said closure has been screwed onto said container neck into a locked condition by acting to force the closure back onto the container neck.

* * * * *